US005233896A

United States Patent [19]

Worthington et al.

[11] Patent Number: 5,233,896

[45] Date of Patent: Aug. 10, 1993

[54] BREAK-NECK STRINGED INSTRUMENT

[76] Inventors: Bradford P. Worthington, P.O. Box 217, Rosemont, N.J. 08556; Christian Allgor, 15 Coryell St., Lambertville, N.J. 08530

[21] Appl. No.: 829,499

[22] Filed: Feb. 3, 1992

[51] Int. Cl.[5] ..... G10D 3/00

[52] U.S. Cl. ..... 84/293

[58] Field of Search ..... 84/267, 268, 269, 291, 84/293

[56] References Cited

U.S. PATENT DOCUMENTS

| | | | |
|---|---|---|---|
| 3,130,625 | 4/1964 | Savona | 84/267 |
| 3,910,151 | 10/1975 | Copeland | 84/267 |
| 4,073,211 | 2/1978 | Jorgensen | 84/291 |
| 4,111,093 | 9/1978 | Field et al. | 84/267 |
| 4,557,174 | 12/1985 | Gressett, Jr. | 84/293 |
| 4,686,882 | 8/1987 | Shaw | 84/291 |
| 4,704,936 | 11/1987 | Steinberger | 84/313 |
| 4,873,908 | 10/1989 | Moore | 84/291 |

*Primary Examiner*—Michael L. Gellner
*Assistant Examiner*—P. Stanzione
*Attorney, Agent, or Firm*—Kenneth P. Glynn

[57] ABSTRACT

The present invention is a string instrument having an instrument body and an extended neck, with strings running from the body to and over a portion of the neck. It includes an outer section of the extended neck and an inner section of the extended neck, these separations being separate from one another. The outer section has a first end and a second end and has string attachment means at its first end. The inner section has a first end and a second end and is connected to said body at its first end. The instrument also includes a connecting member located on the second end of the outer section of the extended neck and a second connecting member located at the first end of the inner section of the extended neck which is adapted to removably connect with the first connecting member in such a manner as to connect the second end of the outer section with the first end of the inner section in a tight butt-to-butt fashion. Preferably, the string instrument neck sections are of a length such that the body and the inner section have a length equal to that of the outer section. In one embodiment, a threaded rod and a ferrule are employed a the connecting members.

20 Claims, 4 Drawing Sheets

BREAK-NECK STRINGED INSTRUMENT

BACKGROUND OF THE INVENTION

1. Field of the Invention

The present invention relates to stringed musical instruments and more particularly to such instruments which are capable of being reduced to approximately one half their length for easier transport and storage. In preferred embodiments, the invention pertains to guitars, especially electric guitars.

2. Prior Art Statement

Conventional stringed instruments, such as violins, banjos, bass guitars, double basses, acoustical guitars, electric guitars and the like come in a variety of shapes and sizes. However, they are generally too large to be conveniently carried and transported, particularly on modern airlines which require the owner to have such guitars transferred with the baggage. Quite often, musicians are forced to purchase an extra seat simply for the guitar, since a modern electric guitar is a somewhat delicate instrument and the owner of such an instrument would prefer that it not be transported with the baggage. In addition, many stringed instruments are very valuable or have their own unique attributes which make them irreplaceable to the owner so that the owner does not want to risk having it lost because it was transported with airline baggage. It is also desirable in other situations that string instruments such as the modern electric guitar be made less bulky in order to be more conveniently carried or transported.

Some prior art collapsible guitars have incorporated a hinged neck which allows the neck portion of the guitar to be folded so as to fit into a suitably sized recess in the main body of the guitar. An example of such a device is given in U.S. Pat. No. 4,073,211 to Jorgensen. The Jorgensen guitar also has grooved portions on the main body which receive the guitar strings when the neck is in a folded position in the main body. Although the Jorgensen guitar folds into a relatively compact form instrument, a primary disadvantage exists in that the folding of the neck involves excess lateral displacement of the strings of the instrument, causing difficulty in handling and alignment of the strings, and resulting in the application of excess tension thereto necessitating that the guitar be retuned after it has been erected into a playable guitar. In addition, the rather large recess in the body of the guitar, and to a lesser extent, the grooves in the guitar body, are believed to have a pronounced effect on the resonance and other musical characteristics of the guitar, as well as mechanical distortions of the instrument's appearance. Consequently, such prior art guitars may not have the desired "sound", simplicity of operation, or instrument-like appearance.

Another prior art collapsible guitar utilizes mechanisms which relax the strings in order to permit the neck to be folded. An example of such a prior art collapsible guitar is disclosed in U.S. Pat. No. 4,111,093 to Field. The Field guitar employs a somewhat complex system of gears and rollers to relax the string tension and additionally employs a spring loaded pin to lock the neck in an extended position when the instrument is to be played. However, a disadvantage with the Field guitar is that its complexity and its sophisticated mechanisms add to the cost of manufacture of the guitar making the guitar somewhat more expensive than other guitars of comparable musical quality. In addition, such complex mechanisms may adversely affect the tonal characteristics of the guitar.

Other prior art collapsible guitars have body sections which are foldable or collapsible. An example of such a prior art guitar is given in U.S. Pat. No. 4,686,882 to Shaw. The Shaw guitar has a main body which has wing-like sections at lateral portions thereof. These wing sections are provided with expander mechanisms which include a threaded stem projecting through one wall in order to manually expand the wings out of their collapsed position into their expanded position. In addition, the Shaw guitar also has a neck portion which is folded by means of a hinge over the top of the instrument body. A major disadvantage with such guitars is the possible pinching when folding the strings over a permanently attached metal bar in order to collapse the guitar. Another important disadvantage with such prior art collapsible guitar is that it is required to have a particular shape, i.e. the wings must be in a triangular form so that the guitar is collapsible, as desired. In addition, the somewhat complex mechanical mechanisms tend to both make the guitar more expensive and adversely affect its tonal characteristics and instrument-like appearance. Finally, and very significant, the Shaw guitar does not fold in half because the entire neck folds over, and an extension block is needed to support the neck when it is unfolded. If the lower bout section of the guitar is eliminated, i.e. as an electric guitar, this disproportion is even more apparent. As shown in FIG. 5 thereof, optimum compactness in length cannot be achieved with the Shaw guitar.

Other patents which typify the state of the art in the development of compact stringed instruments include U.S. Pat. No. 3,910,151 to Copeland; U.S. Pat. No. 3,130,625 to Savona; U.S. Pat. No. 4,704,936 to Steinberger, and U.S. Pat. No. 4,873,908 to Moore. The Copeland patent has a fold over neck which also has a swing over string end tension plate on the body, has two folds in the strings and also requires both hinges and a separate attachment screw as well as a body extension or ledge for the neck in the open position. The remaining patents are directed to compactness with features other than break-neck.

Thus, a collapsible stringed instrument is needed that can be collapsed into a form in which it has reduced length to maximum extent, i.e. in half. Moreover, a collapsible instrument is needed with such attributes as a relatively simple design, an easily collapsible form, and the desired tonal characteristics, as well as the ability to maintain a fine instrument-like appearance.

SUMMARY OF THE INVENTION

The present invention is a string instrument having an instrument body and an extended neck, with strings running from the body to and over a portion of the neck. It includes an outer section of the extended neck and an inner section of the extended neck, these sections being separate from one another. The outer section has a first end and a second end and has string attachment means at its first end. The inner section has a first end and a second end and is connected to said body at its first end. The instrument also includes a first connecting member located on the second end of the outer section of the extended neck and a second connecting member located at the first end of the inner section of the extended neck which is adapted to removably connect with the first connecting member in such a manner as to connect the second end of the outer section with the first end of the inner section in a tight butt-to-butt fashion. Preferably, the string instrument neck sections are of a length such that the body and the inner section have a length equal to that of the outer section. In one embodiment, a threaded rod and a ferrule are employed as the connecting members.

BRIEF DESCRIPTION OF THE DRAWINGS

The present invention is more fully understood when the present specification is taken in conjunction with the drawings appended hereto wherein.

DETAILED DESCRIPTION OF THE INVENTION

The present invention is directed to a "break-necked" stringed instrument developed to enable it to be folded in two, thus, eliminating many of the problems of the prior devices. Ideally, although not limited thereto, the present invention instruments may be made to fold exactly in half. Also, the present invention relies upon a common capo, already a useful accessory for the player, to hold the strings, and the invention permits break down of the neck, storage and subsequent reassembly without the need for removing, adjusting or retuning the strings. The stringed instrument of the present invention may be any hand held type or stand up type having a neck and may be acoustic, electric, electronic or otherwise. It may be a guitar and is preferably a guitar, e.g. a six or twelve stringed guitar or a bass guitar. It may be constructed of predominantly natural material or synthetic or a combination, including wood, ceramic, graphite, metal and plastic. The strings may be natural or synthetic.

In using the break-neck string instrument of the present invention, the musician is able to assemble the device by connecting the outer and inner sections, without the need for special tools or skill and yet will have an instrument that does not sacrifice sound quality or product feel, and maintains its appearance as an instrument and not a mechanical device. Balance, size, relationships of the parts, etc., will all be natural and ordinary and no bulk extensions or shelves are needed nor is any extra thickness, length or width required. The present invention overcomes the difficulties of earlier fold over type guitars and offers the musician new opportunities for compact handling, storing and transporting of the device.

The present invention is described in conjunction with the drawings in terms of an electric guitar having a compact body, but may be any of the types of necked/stringed instruments available.

Figure 1:
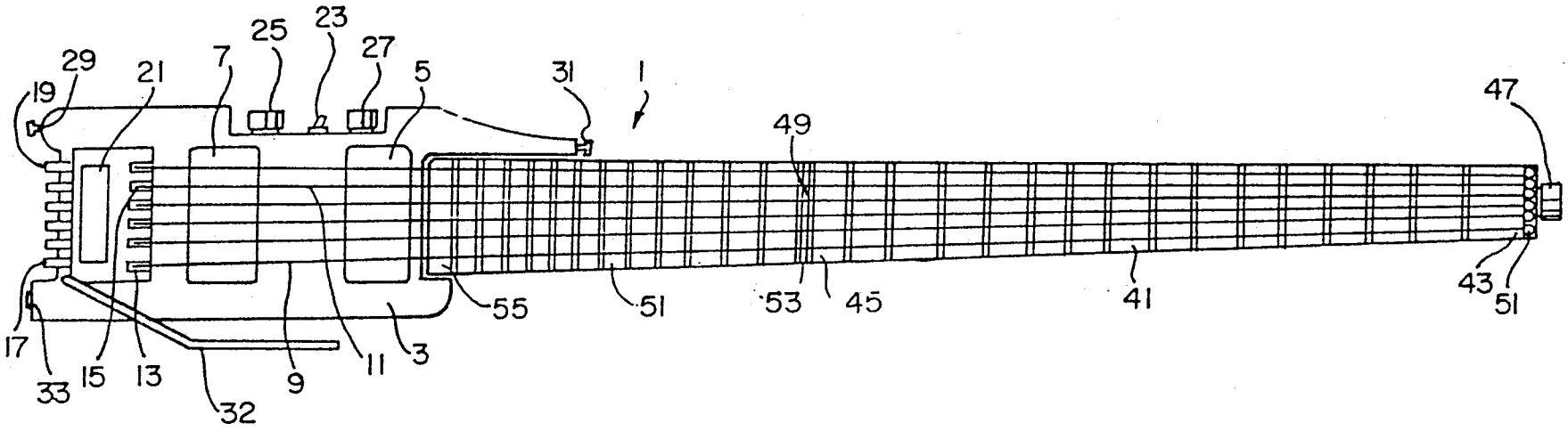
FIG. 1 shows a front view of a preferred electric guitar of the present invention in its open position.

Referring now to FIG. 1, there is shown generally a front view of a stringed instrument 1. This could be a banjo, violin, bass, double bass, acoustic guitar or other stringed instrument, but in this case is an electric guitar. In preferred embodiments, the present invention is a guitar.

Instrument 1 includes a body 3 having front pick-up 5 and rear pick-up 7, a conventional electric guitar type arrangement. This instrument 1 has six strings as exemplified by strings 9 and 11. Strings such as 9 and 11 are attached to body 3 by anchors such as anchors 13 and 15. These strings are tuned or adjusted by knobs 17 and 19 connecting to a threaded portion (not shown) of the anchors. A raised bumper 21 is included on body 3 to act as a rest for the user as well as for the neck first end 43 of neck outer section 41 when it is in its broken-down mode.

Toggle switch 23 acts as a multiposition on-off control and knobs 25 and 27 control the pick-up (and therefore volume) of rear and front pick-ups 7 and 5, respectively. Flanged pegs 29 and 31 are provided for neck strap attachment. Jack port 33 is provided for wiring to a sound system. Vibrato bar 32 is also shown.

FIG. 1 also shows an extended neck from body 3 which has two parts, namely, outer section 41 and inner section 51. Outer section 41 has a first end 43 and second end 45 at interface line 49. First end 43 of outer section 41 includes string attachment means such as means 51 (e.g. anchors or "keyhole" wells) for securing strings. Second end 45 has a first connecting member (rod 67 in FIG. 2 below) located therein which connects to a second connecting member (ferrule 81 in FIG. 2 below) located in inner section 51. Details are described below. Inner section 51 includes first end 53 and second end 55. Second end 55 is permanently attached to body 3.

In FIG. 1, body 3 with inner section 51 and, separately, outer section 41 have been connected together with connecting means and are shown fully connected. It is an objective of the present invention to provide a stringed instrument with an extended neck which is a full break-apart two section neck. The neck comes fully apart but the strings may, and preferably will remain attached and set to be fine tuned upon reassembly of the neck positions. Thus, FIG. 2 shows a partial top cut view of the two neck positions disassembled and about to be reassembled.

Figure 2:
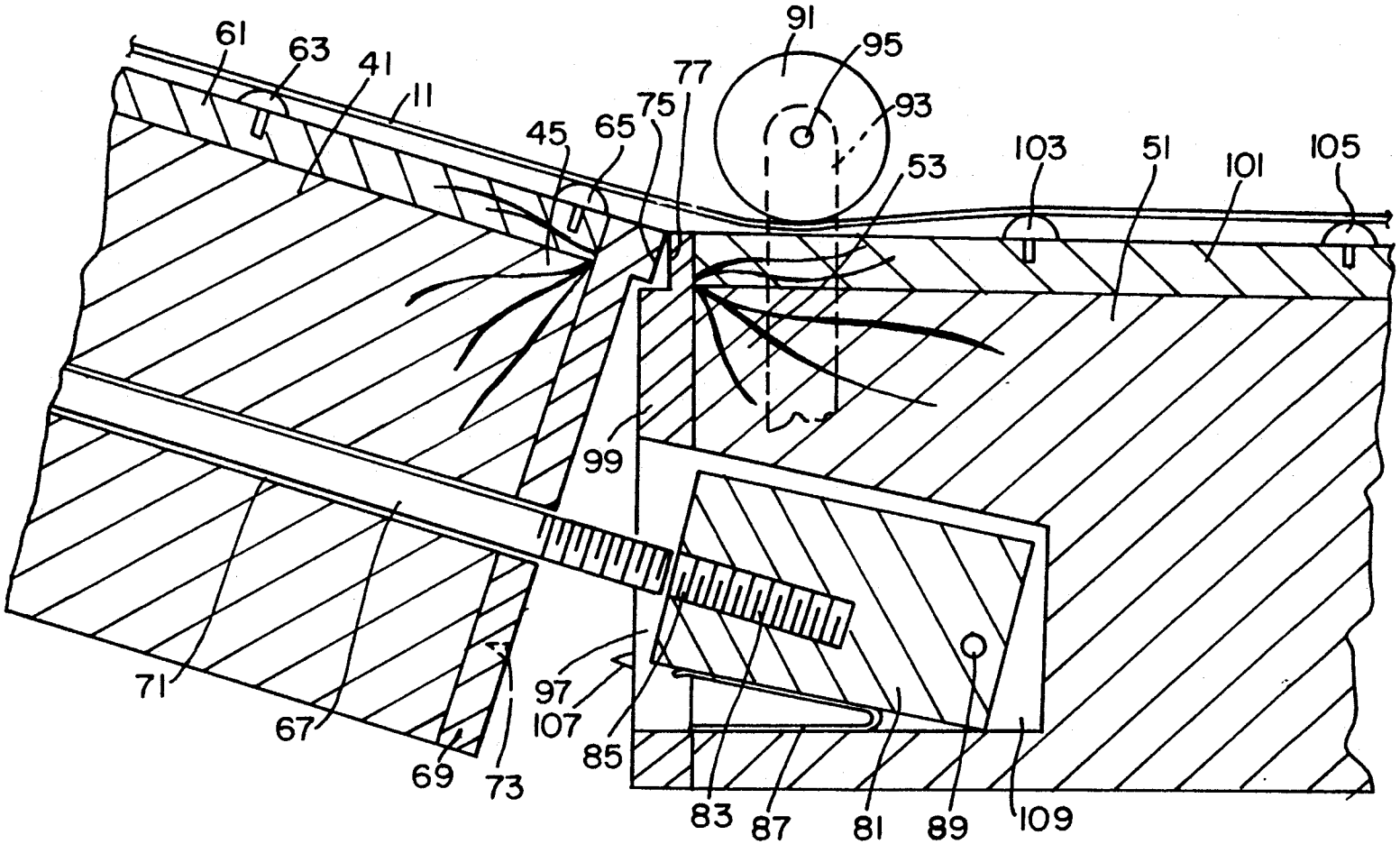
FIG. 2 is partial cut top view of two sections of a neck of an instrument of the present invention.

In FIGS. 1 and 2, like parts are shown and are identically numbered. Outer section 41 is at its second end 41 has an optional plate 69. This may be high impact plastic, machined metal or alloy, e.g. stainless steel. Its purpose is to ensure longevity and accuracy of the guitar as well as to protect typical wood portions of the neck. It is not necessary but preferable to assure minimal wear and "drift" over many years of use. This is also true of plate 99 discussed below.

Outer section 41 also includes fretboard 61 and typical frets 63 and 65. In this embodiment, hollow opening 71 runs the entire length of outer section 41 and has threaded rod 67 with threads 73 extends to and is rotatably connected to knob 47 shown in FIG. 1. Plate 69 contains inset or recess 73 and extended ledge 75 to assist in alignment during attachment of outer section 41 to inner section 51. The ledge and recess constitute geometries which will be complementary with those of the abutting first end 53 of inner section 51. They need not be ledges or pointed recesses, but any interconnecting/aligning complementary geometries may be used.

Inner section 51 at its first end 53 has plate 99 permanently attached thereto and plate 99 includes inward ledge 77 and pin 107 (one of two, for example) which are complementary geometries to extended ledge 75 and recess 73, respectively. Inner section 51 also includes fretboard 101 and typical frets 103 and 105. A relatively large, tapered oval recess 108 is formed into first end 53 and plate 99 has a corresponding opening 97. Recess 107 contains female ferrule 81, which includes threads 83 in orifice 85 and rotatably attached by pin 89. Spring 87, which is optional but preferred, biases ferrule 81 toward threaded rod 67.

To assemble, knob 47 of FIG. 1 is rotated, e.g. clockwise, while outer section 41 is brought to alignment with inner section 51 so that threaded rod 67 is threaded into ferrule 81. Resilient capo 91 with axle 95 and elastic strap 93 (partially shown) may optionally be used to hold the strings and neck section 41 at its second end 45 in place when the instrument 1 is disassembled and outer section 41 is placed atop the capo 91 over inner section 51 and also rests on bumper 21 (FIG. 1).

During assembly, as knob 47 is rotated and rod 67 screws into ferrule 81, the ferrule 81 hinges away from fretboard 101 and towards linear alignment with inner section 51. Likewise, outer section 41 moves toward such alignment, and when knob 47 is tight, all complementary geometries are seated and the inner section 51 and outer section 41 are connected via the rod 67 and ferrule 81 connecting means in a butt-to-butt fashion at interface 49, shown in FIG. 1. (This interface 49 may, for example be in the area of the 13th, 14th, or 15th fret, depending upon the length of the neck and body of the particular instrument).

Figure 3:
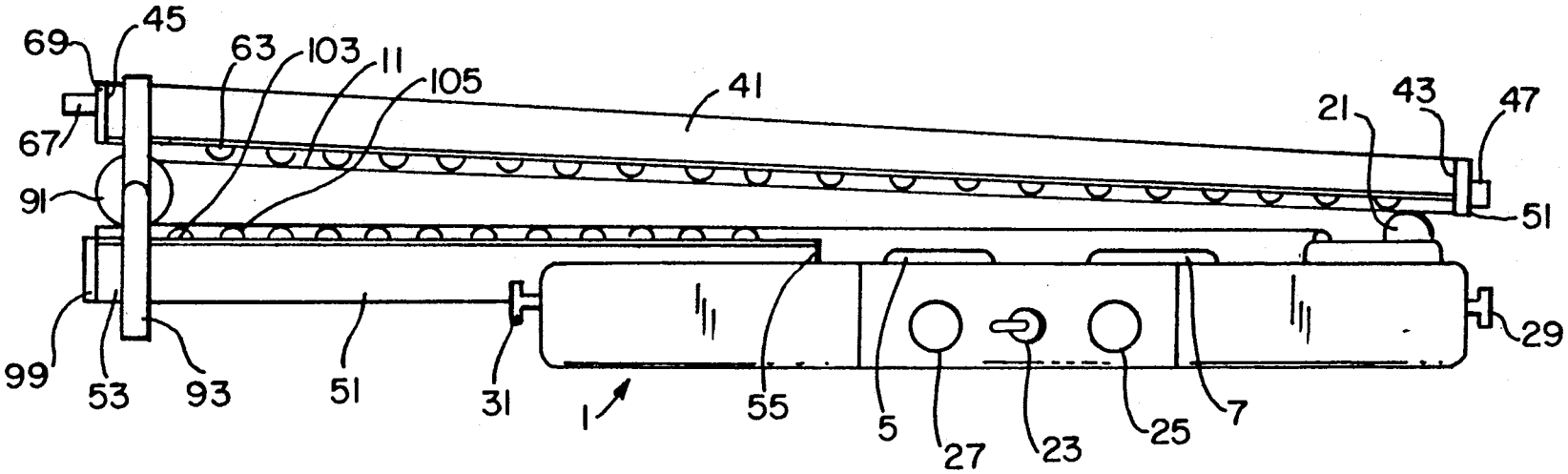
FIG. 3 is a top view of the present invention instrument of FIGS. 1 and 2, but in a fully collapsed form.

FIG. 3 shows instrument 1 in its completely broken down position, top view. Identical parts shown in FIGS. 1 and 2 are identically numbered. Note that typical string 11 passes over capo 91 and that outer section 41 is completely disconnected from intersection 51. Outer section 41 rests atop capo 91 at its second end 45 and is secured by capo strap 93 and also rests atop raised bumper 21 at its first end 43. Instrument 1 is next placed in an appropriately molded carrying case designed to secure both sections for safe storage and transport.

The embodiment shown thus far has a break point equidistant from the outer ends of the instrument. However, exactly equal lengths are not essential. Further, while the ferrule and threaded rod are shown in specific sections, this could be done oppositely. Also, a rod need not go the full length of a section as it could have a cranking wheel within an inch or two or three of the particular section end in which it is located. Likewise, the connecting member need not be a threaded rod and ferrule. Other fasteners could be utilized, e.g. interlocking hooked members, one optionally being rotated to assure accurate alignment with maximum tightness, buckle and loop like a reversing latch buckle of a snowboot. While other known mechanisms for the connecting means are contemplated, the threaded rod and ferrule are preferred due to the parameter advantages in alignment, tightness and strength when assembled.

Figure 4:
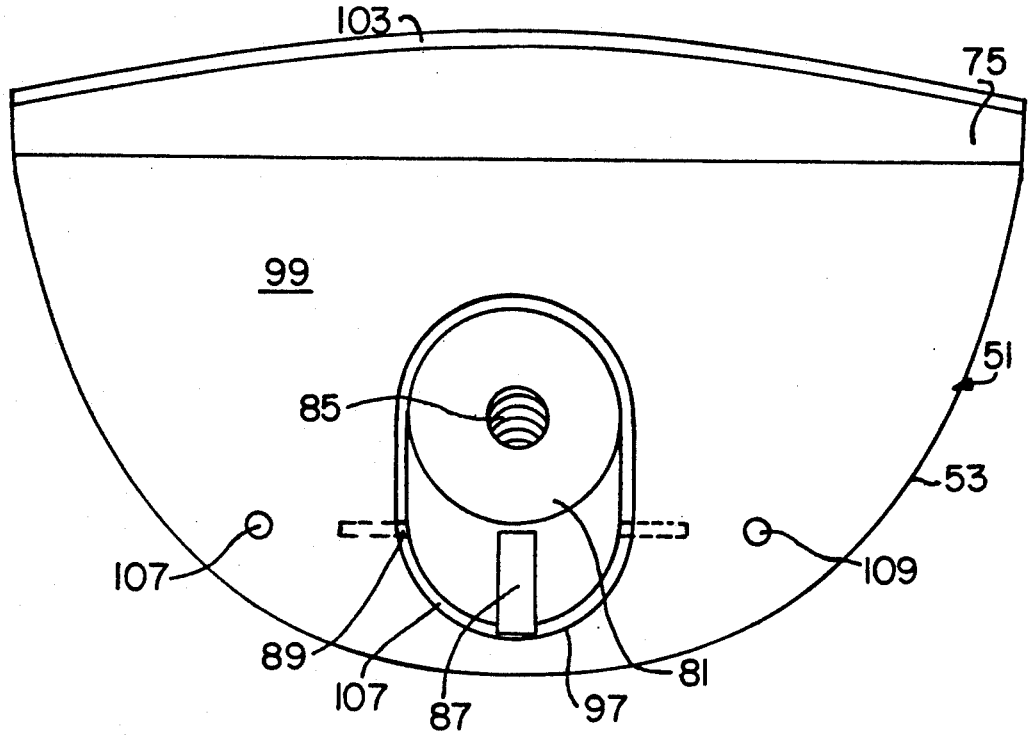
FIG. 4 is a side (end) view of a neck portion shown in FIG. 2.

FIG. 4 shows an end view of first end 53 of inner section 51. Like parts are like numbered with respect to the common elements shown in FIGS. 1 and 2. Here, plate 99 is the full width, height and shape of first end 53 and has two alignment pins 107 and 109. Ferrule 81 is shown in its fully biased position caused by spring 87.

Figure 5:
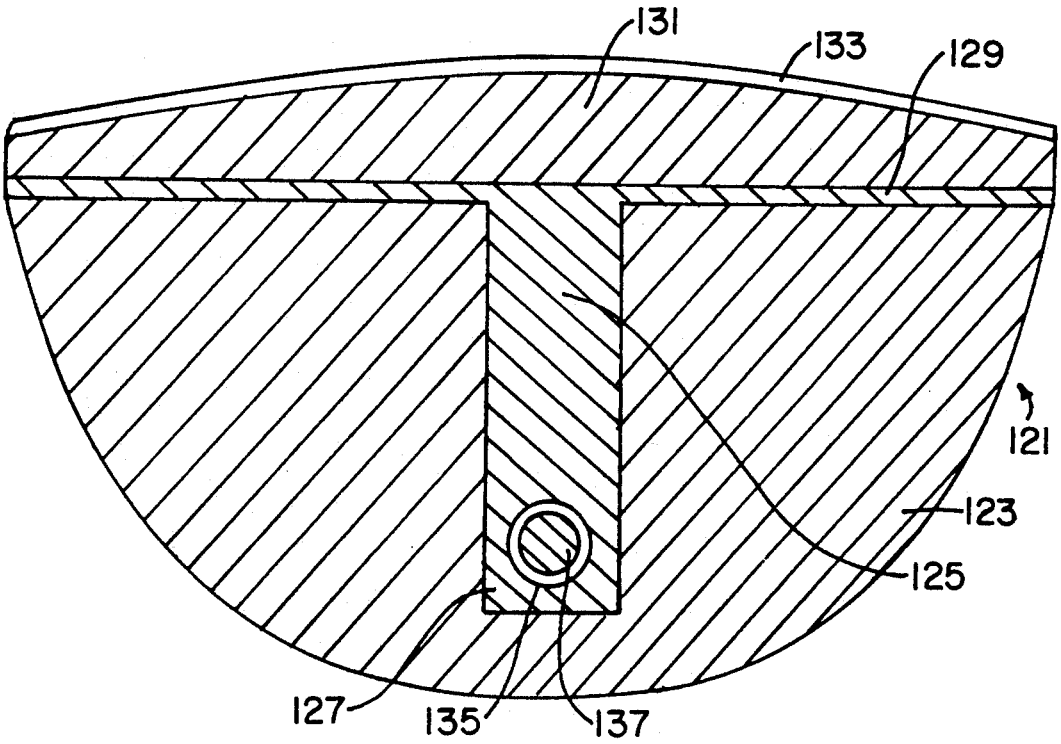
FIG. 5 is a side (end) view of an alternative neck portion of a present invention stringed instrument.

FIG. 5 shows an end view of an alternative embodiment second end of an outer neck section. Here, outer section 121 is made of wood and is routed or otherwise contains a cutout for a T-beam 125 shown at second end 123. T-beam 125 may be made of metal, high strength plastic or graphite and allows for the neck to be and have the feel of wood but with extra strength to impede warpage. Graphite is one material of choice.

T-beam 125 has a base 127 and a top 129 and runs the length of neck outer section 121. It also has an opening 135 in its base 127, through which threaded rod 137 passes, and acts in conjunction with a ferrule or the like as connecting means. Atop the top 129 of T-beam 125 is attached a wood fingerboard or fretboard 131 with typical fret 133, to complete the wood external aspects and yet still achieve the structural integrity of man-made materials.

While not a feature of the present invention break-neck stringed instrument, an important accessory thereto is a carrier molded to receive the stringed instrument in the disassembled mode. The cover closes to snugly fit and hold the outer section of the neck in place. This carrier is preferably brushed aluminum outer skinned with a foam inner support.

Obviously, numerous modifications and variations of the present invention are possible in light of the above teachings. It is therefore understood that within the scope of the appended claims, the invention may be practiced otherwise than as specifically described herein.

What is claimed is:

1. In a string instrument having an instrument body and an extended neck and with strings running from the body to and over a portion of the neck, the improvement which comprises:

(a) an outer section of said extended neck and an inner section of said extended neck said sections being separate from one another, said outer section having a first end and a second end and having string attachment means at said first end, said inner section having a first end and a second end and being connected to said body at said second end;

(b) a first connecting member located on the second end of said outer section of said extended neck; and, (c) a second connecting member located at the first end of said inner section of said extended neck and adapted to removably connect with said first connecting member in such a manner as to connect the second end of said outer section with the first end of said inner section in a tight butt-to-butt fashion and adapted to removably disconnect with said first connecting member in such a manner as to completely disconnect and separate the second end of said outer section with the first end of said inner section;

whereby said extended neck may be broken down and subsequently reassembled without the need for removing, adjusting or retuning the strings.

2. The string instrument of claim 1 wherein said first connecting member and said second connecting member are a female ferrule and a threaded rod.

3. The string instrument of claim 2 wherein said threaded rod is rotatable for screwing into said ferrule.

4. The string instrument of claim 3 wherein said outer section of said extended neck includes a hollow opening through its entire length and said threaded rod has a length in excess of said outer section and extends entirely through said hollow opening.

5. The string instrument of claim 4 wherein a knob is attached to said threaded rod at the first end of said outer section for rotation of said threaded rod for connection to said female ferrule.

6. The string instrument of claim 4 wherein said female ferrule is rotatably mounted on the first end of said inner section so as to be aligned with said threaded rod in a straight line throughout threading.

7. The string instrument of claim 3 wherein said female ferrule is rotatably mounted on the first end of said inner section so as to be aligned with said threaded rod in a straight line throughout threading.

8. The string instrument of claim 2 wherein said female ferrule is rotatably mounted on the first end of said inner section so as to be aligned with said threaded rod in a straight line throughout threading.

9. The string instrument of claim 1 further comprising a male and female complementary geometries at said second end of said outer section and said first end of said inner section to assist in alignment and interlocking of said outer and inner sections of said extended neck when connected to one another.

10. The string instrument of claim 9 wherein said complementary geometries include at least one raised portion and one complementary recessed portion.

11. The string instrument of claim 1 wherein said instrument is a guitar.

12. The string instrument of claim 11 wherein said first connecting member and said second connecting member are a female ferrule and a threaded rod.

13. The string instrument of claim 12 wherein said threaded rod is rotatable for screwing into said ferrule.

14. The string instrument of claim 13 wherein said outer section of said extended neck includes a hollow opening through its entire length and said threaded rod has a length in excess of said outer section and extends entirely through said hollow opening.

15. The string instrument of claim 14 wherein a knob is attached to said threaded rod at the first end of said outer section for rotation of said threaded rod for connection to said female ferrule.

16. The string instrument of claim 14 wherein said female ferrule is rotatably mounted on the first end of said inner section so as to be aligned with said threaded rod in a straight line throughout threading.

17. The string instrument of claim 12 wherein said female ferrule is rotatably mounted on the first end of said inner section so as to be aligned with said threaded rod in a straight line throughout threading.

18. The string instrument of claim 13 wherein said female ferrule is rotatably mounted on the first end of said inner section so as to be aligned with said threaded rod in a straight line throughout threading.

19. The string instrument of claim 11 further comprising a male and female complementary geometries at said second end of said outer section and said first end of said inner section to assist in alignment and interlocking of said outer and inner sections of said extended neck when connected to one another.

20. The string instrument of claim 19 wherein said complementary geometries include at least one raised portion and one complementary recessed portion.

* * * * *